United States Patent [19]

Demonte et al.

[11] 4,323,315

[45] Apr. 6, 1982

[54] ELECTRONIC TYPEWRITER WITH DISPLAY DEVICE

[75] Inventors: Filippo Demonte, Cavaller Maggiore; Mario Figini, Bosco Marengo, both of Italy

[73] Assignee: Ing. C. Olivetti & C., S.p.A., Ivrea, Italy

[21] Appl. No.: 120,747

[22] Filed: Feb. 12, 1980

[30] Foreign Application Priority Data

Feb. 9, 1979 [IT] Italy ..... 67280 A/79

[51] Int. Cl.[3] ..... B41J 5/30; B41J 3/46

[52] U.S. Cl. ..... 400/63; 400/22; 400/83; 400/144.2

[58] Field of Search ..... 400/22, 17, 83, 70, 400/144.2, 61-63; 340/703, 707, 723, 735, 790

[56] References Cited

U.S. PATENT DOCUMENTS

| | | | |
|---|---|---|---|
| 3,630,336 | 12/1971 | Johnson et al. | 400/17 |
| 3,868,673 | 2/1975 | Mau, Jr. et al. | 340/723 X |
| 3,893,558 | 7/1975 | Fulton et al. | 400/124 |
| 4,204,206 | 5/1980 | Bakula et al. | 340/721 |

FOREIGN PATENT DOCUMENTS 2621146 11/1977 Fed. Rep. of Germany ..... 400/83

OTHER PUBLICATIONS

*IBM Tech. Disc. Bulletin*, by J. S. Coehen et al., vol. 19, No. 8, Jan. 1977, p. 2821.

*Primary Examiner*—Paul T. Sewell

*Attorney, Agent, or Firm*—Schuyler, Banner, Birch, McKie & Beckett

[57] ABSTRACT

An electronic typewriter having a display device which shows just the last entered characters of a printing line. The typewriter comprises a selector for an immediate typing mode of the entered character, a line/line mode in which each line is set up in memory and typed on operating a service key, and a word/word mode in which the set up words are typed word by word, i.e. on each operation of the space bar. This facilitates typing with checking to eliminate all errors. The display device shows emphasized characters, different kinds of emphasis (heavy type, light type on dark background being indicated by different luminous dot patterns under the characters. The display device is of the dot matrix type and, by suitable circuits thereto superposed characters, e.g. 0 and 1 yielding $\phi$, are correctly shown.

5 Claims, 8 Drawing Figures

ELECTRONIC TYPEWRITER WITH DISPLAY DEVICE

BACKGROUND OF THE INVENTION

The present invention relates to an electronic typewriter comprising a display device, a keyboard for the input of data and a memory for storing the data fed into the machine.

A machine of this type is already known in which the display device is used for monitoring the data fed into the machine. After the line has been composed, the actuation of a service key causes deferred printing of the line of fed-in data. For reasons of cost, the capacity of the display is less than the writing capacity and the display is limited to the last data introduced. This machine permits perfect composition of the line of print but, even in ordinary typewriting work, with lines which are thought to be possibly incorrect, it is often necessary to pass the data through the display device to check the data at the beginning of the line, which is no longer visible. This slows down the printing of the data. Direct printing of the data fed in, waiving viewing, may on the other hand give rise to printing errors which, although they can be corrected, still represent a slowing down of the average typing speed.

SUMMARY OF THE INVENTION

The object of the present invention is therefore to provide an electronic typewriter with a display device, which is of relatively moderate cost, which permits immediate monitoring of the data fed in and a high average speed of completion of printing.

According to the present invention there is provided an electronic typewriter comprising a display device, a keyboard for the input of data, a memory for storing the input data, a selector means operable for selecting delayed writing and a service key which responds when delayed writing is selected to write, word by word, the data introduced into the memory and displayed on the display device.

Further according to the invention, there is provided an electronic typewriter with a means for presetting a mode which produces emphasized type, and a display device which responds in the emphasized type mode to display in an emphasized manner in relation to the other data the data which has been fed in and which is to be emphasized.

Further according to the invention, there is provided an electronic typewriter comprising a display device, an input means, a matrix for generating signals capable of displaying in sequence the data fed into the machine, and a circuit element which represents in one and the same position of the display device, in a superposed relationship, more than one item of input data as a sum of the signals generated by the matrix in response to the keying of the said data.

BRIEF DESCRIPTION OF THE DRAWING

The invention will be described in more detail, by way of example, with reference to the accompanying drawings, in which.

DESCRIPTION OF A PREFERRED EMBODIMENT

Figure 1:
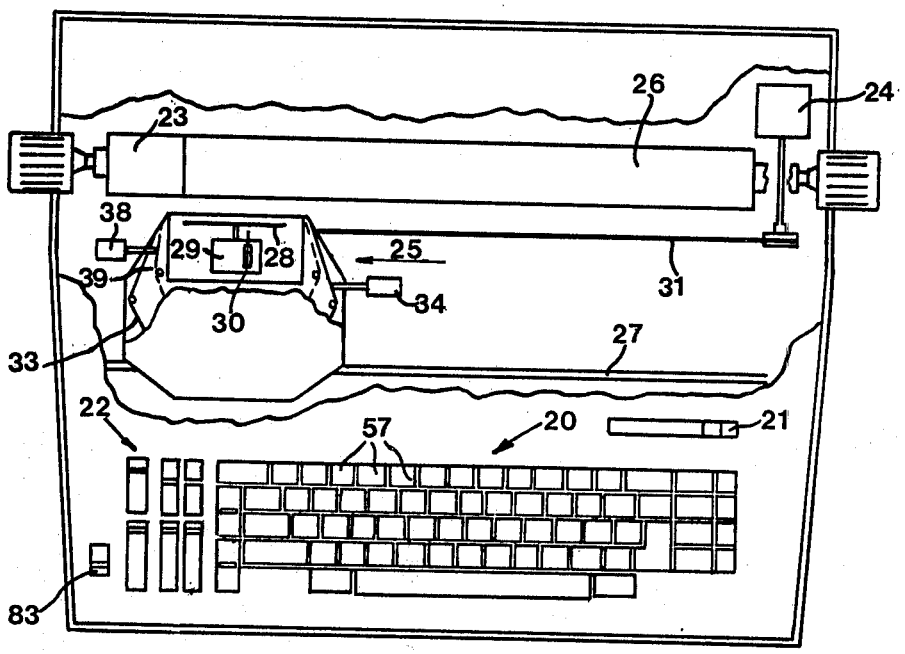
FIG. 1 is a plan view of an electronic typewriter with a display device displaying the data stored, embodying the invention.
Figure 2:
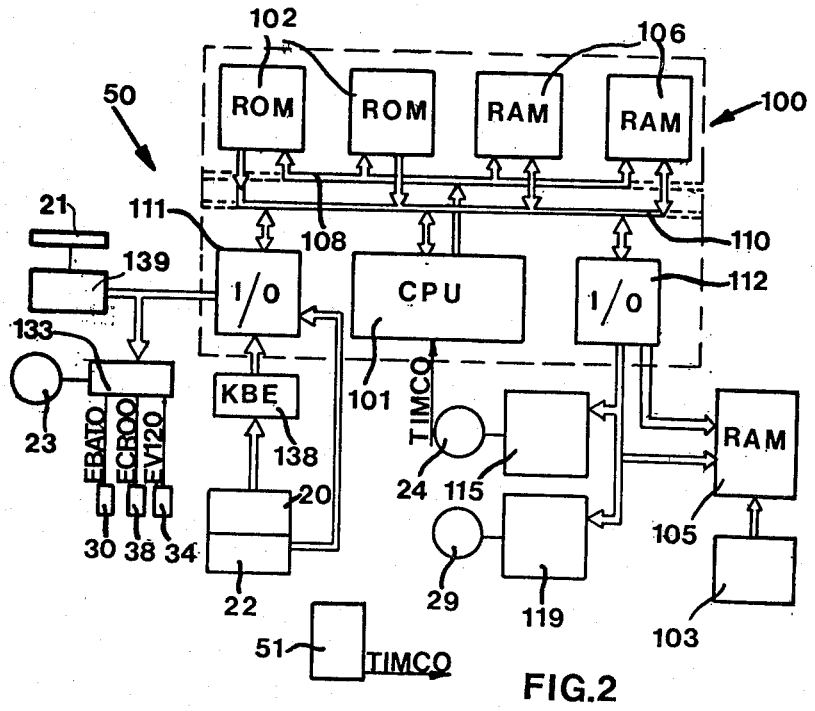
FIG. 2 is a block diagram of the logic unit which controls the typewriter.

The typewriter 10 in FIG. 1 is of the type described in the specification of Demonte et al U.S. patent application Ser. No. 58,202, filed July 17, 1979, and assigned to Ing. C. Olivetti & C., SpA and comprises an alphanumerical keyboard 20, a control console 22, a display device 21, a platen 26, a serial printing unit 25 and an electronic control unit 50 (FIG. 2).

The printing element 25 comprises a character carrying element 28 of the daisy wheel type, rotated continuously by a motor 29, a striker hammer 30, a writing ribbon 33 and a correcting ribbon 39.

Figure 3:
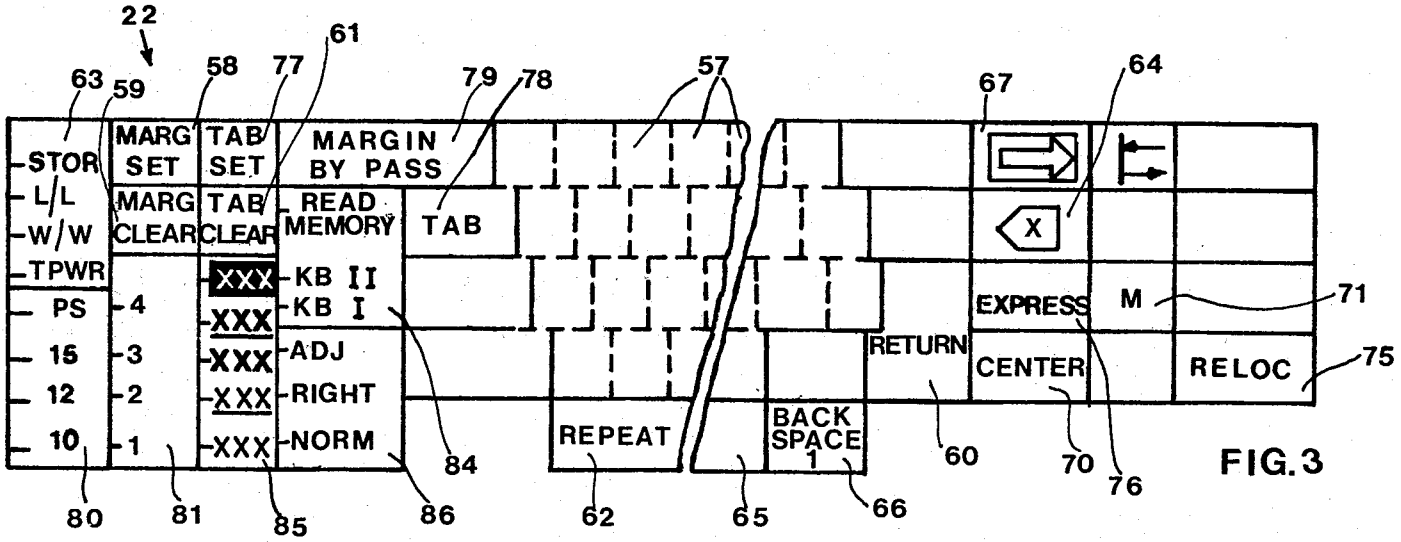
FIG. 3 illustrates the layout of the keyboard.

With reference to FIG. 3, the keyboard 20 in addition to the normal alpha-numerical keys 57, also comprises the following service keys: Margin set 58, margin clear 59, margin by-pass 79, cancellation of tab stop (TAB CLEAR) 61, setting of tabulation stops (TAB SET) 77, centering (CENTER) 70, tabulation (TAB) 78, repeat (REPEAT) 62, space bar 65, return to beginning with line space, i.e. new line, (RETURN) 60, movement forwards on display 67, single backspace (BACK SPACE-1) 66, cancellation 64 and constant phrase selector (M) 71. In addition, the keyboard 20 also comprises a rapid movement and code key (EXPRESS) 76 and a relocation key (RELOC) 75. The function operated by these keys will be described hereinafter.

The unit 50 (FIG. 2) comprises a microprocessor 100, two control units 115 and 119, respectively for the transport motor 24 and selection motor 29, actuating circuits 133 for the hammer 30, electromagnets 34 and 38 and the motor 23, a timing unit 51, the control console 22, a keyboard encoder (KBE) 20 and a circuit 139 for operating the display device 21.

The microprocessor 100 is of known type and comprises a central unit (CPU) 101, ROM memories 102 for storing the sequence of micro-instructions, a working RAM memory 105 used for temporary storage of data, and input/output units (I/O) 111 and 112 for exchanging data and commands with logic units 115, 119, 133, 138 and 22. The unit 50 also comprises a RAM 105 which is rendered non-volatile in use by a buffer battery 103.

The console 22 comprises a key 83 (FIG. 1) for switching the machine on and off, a selector 81 (FIG. 3) which selects the line spacing between 1, 2, 3 or 4 elementary line spaces, a selector 80 which selects one of the type spacings of 1/10", 1/12", 1/15"(2.5 mm, 2.1 mm, 1.7 mm) or proportional spacing and a selector 63 which can select a STORAGE condition which makes it possible to record data in the non-volatile memory 105, line/line for the delayed typing of memorized lines of text, word/word for the delayed writing of a word at a time and a machine condition TPWR for immediate, normal typewriting.

The console 22 is also provided with a selector 84 which can be positioned to READ MEMORY for reading stored data, an editing selector 85 for selecting typing in normal mode, underlined, heavy type, heavy type and underlined and in reverse (light type on dark ground) and a selector 86 which can be positioned in a NORM position for the immediate print of the characters, an ADJUST position for the automatic return of the print unit to the beginning of a line and a RIGHT position for composing the line of type justified to the right margin.

The memories 106 comprise a buffer having the capacity to store the positions of the unit 25 for two lines of characters. Stored in the buffer are the codes of the symbols fed in by the keyboard and printed or on the point of being printed by the machine in the line of type which is in course of being set and in the preceding line. These codes identify in particular the information needed for edited printing of the characters.

Figure 4:
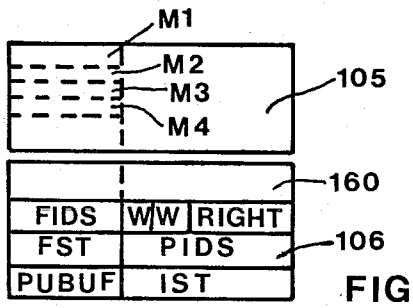
FIG. 4 illustrates the arrangement of a memory device.

The non-volatile memory 105 has a capacity to contain the parameters of the current sample line and a part which may contain a series of characters and/or instructions for constant phrases and page formats, organized in such a way that it can be subdivided into up to ten selected positions M1, M2 etc (FIG. 4) by operation of the key 71 followed by the number of the desired memory.

The display device 21 displays up to 20 characters with a matrix of high definition illuminated dots. In particular, the display device shows letters, numbers and symbols provided on the keyboard, service symbols and shows at character level the editing of the same with regard to underlining, heavy type, heavy type plus underlining, or in reverse. Furthermore, it administers and displays the dead keys and the superposed characters.

The display is sub-divided into two zones, the first zone or service zone 87 (FIGS. 5 and 6) being constituted by four characters starting from the right and dedicated to service information while the second zone, the working zone 88, is constituted by 15 characters starting from the left and it is devoted to the display of the characters introduced via the keyboard. Between the two zones is the symbol ◄, in order to separate the two zones and simplify identification of the point of input which is represented by the character which is farthest rightwards in the working zone, i.e. next to the symbol ◄.

Figure 5:
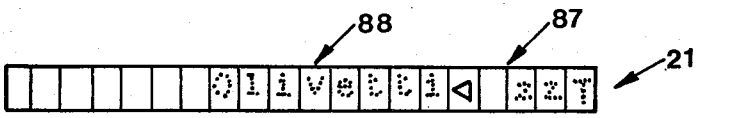
FIGS. 5 and 6 show the examples of operation of the typewriter.
Figure 6:
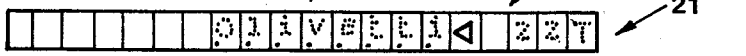

The service zone 87 of the display 21 is arranged in such a way that the first character on the right indicates the machine condition with the symbols "S", "L", "W", "T" which represent Storage, Line/Line, Word/Word, Typewriter respectively. The remaining three characters on the other hand have the function of counting characters and of indicating the effective writing areas. In some cases, these indications are replaced by specific indications dependent upon the actual case in question. FIGS. 5 and 6 show the machine in Typewriter mode with 22 character spaces left in the current line.

With the machine condition selector 63 preset for line/line, the data fed in is stored in the line buffer, and actual writing occurs only after operation of the RETRUN (new line) key 60 or the EXPRESS key 76 or automatically upon operating the space bar or the hyphen key in a predetermined range adjacent the right margin if the composition selector 86 is set to automatic ADJUST or RIGHT. During input of data via the keyboard, the service zone 87 of the display device 21 indicates the number of characters between the theoretical position of the typing head and the right-hand margin, while passing beyond the left or right-hand margins via margin by pass key 79 is indicated by the symbol "—" which replaces the three character counting digits and is positioned to the left or right as the case may be.

The working zone 88 displays the last character keyed in at the input point and causes the remaining characters to shift to the left. Operation of some service keys produces changes in the display. In particular, Back Space 66 moves to the right by one character the contents of the display and movement forwards on display 67 moves the contents to the left. Furthermore Express 76 results in a rapid return to the beginning of the line and Relocate 75 produces rapid return to the last character keyed in. Finally, operation of Cancel 64 causes the buffer and the display to cancel the character present at the working point and shifts to the right the remaining contents of the display.

Movement of the keyboard selector 84 to READ MEMORY causes disappearance of the contents of the working zone 88 of the display though these contents remain stored in the buffer. The service zone 87 of the display on the other hand continues to show the indications which preceded positioning to READ MEMORY. By keying M 71 plus the number corresponding to the memory the contents of which it is desired to check, it is possible to display in the working zone 88 of the display the first 15 characters from the memory zone called upon, sufficient to recognize the contents of the memory. Successive actuations of M and its number make it possible to carry out the above check on all the memories called upon. Then if the keyboard selector 84 is restored to the initial position, the working zone 88 of the display will show the same information as existed before the switch to READ MEMORY and the contents of the buffer will not be altered. At this point, it is possible either to call forward the contents of the memory selected so that they can be typed, or it is possible to continue with ordinary typewriting.

The machine can show on the display and then write in one and the same printing position two superposed characters in order for example to increase the possibility of writing in languages other than those specific to the keyboard and the printing unit, e.g. to create the character $\phi$. In cases where one of the characters is of the "dead" type, that is to say a character which does not involve a space being taken, it is sufficient to key the dead key first and afterwards to key the superposing key. In cases where both characters are live, after operating the key 57 for the first character, it is necessary successively to operate the Back Space key 66, Repeat key 62 and the key 57 for the second character. This produces a superposed display of the two characters.

The superimposition of the characters on the display is achieved by using a matrix with a capacity equal to that needed for the display of different characters. For this purpose, an "OR" gate is provided which uses in alternating cycles the outputs of the matrix relative to the two characters in order to display a combination of the two superposed characters.

The editing selector 85 is capable of presetting the writing of the characters so that they stand out clearly in relation to the other parts of the text. This emphasis is obtained by underlining or by making the characters appear in heavy type, underlined heavy type or by typing in negative or reverse form. This last-mentioned is achieved by preparing a background in the space associated with the character, by means of the ribbon, then cancelling from the background by means of the correcting tape that part of the background which corresponds to the character which is to be emphasized.

Whereas underlining is represented directly on the display device 21, the other methods of emphasis are shown in coded form. In particular, for writing in heavy type, an illuminated spot appears in the bottom left-hand part of every character; this is illustrated in FIG. 6. For writing in "underlined heavy type" a further three dots separated by a space, are added to the dot previously mentioned. For writing in "reverse" on the other hand, two spots of light shown in the bottom right-hand part or alternatively the background is made luminous and the character which is to be shown up remains dark.

With the machine condition selector 63 set for Word-/Word functioning, printing is delayed until the end of the word and takes place at each space, each automatic or manual new line, and at each TAB. The service zone 87 of the display will operate in the same way as the Line/Line condition. The working zone 88 functions in a fashion similar to the Line/Line condition except that printing is delayed also until keying of space or automatic or manual new line or TAB. In the Word/Word condition, feeding of a hyphen during continuous printing from store is made for all types of margining before printing of the line in question commences.

With the condition selector 63 set for Typewriter TPWR function, there is direct connection between keyboard and printer. Printing will then immediately follow keying. The service zone 87 of the display functions indentically to the Line/Line and Word/Word conditions while the working zone 88 is normally not activated except for settings to RIGHT, CENTER, TAB and hyphen.

Figure 8:
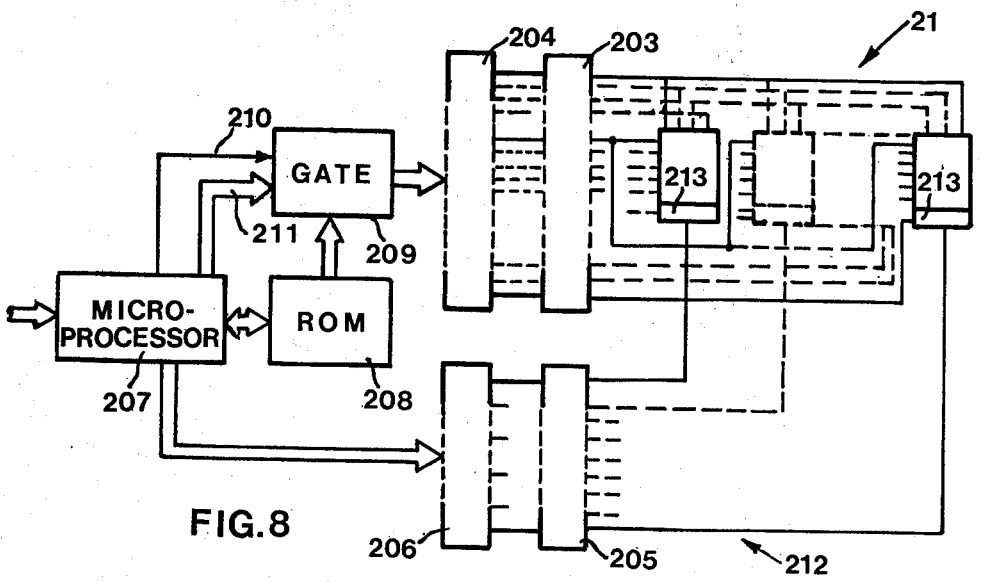
FIG. 8 is a block diagram of a control device of the typewriter of the invention.

FIG. 8 shows an example of circuits used to perform control of display 21 and superimposition of characters thereon. Each one of the twenty cells of display 21 comprises a $5\times12$ matrix of dots driven by sixty lines of a high voltage driver 203 fed by a corresponding sixty position shift register 204. Moreover another high voltage driver 205, serially sets the twenty cells of display 21 under the control of a twenty position shift register 206 through twenty output lines 212.

Registers 204 and 206 memorize the output signals of a microprocessor 207 of known type which receives two bytes of eight bits for each one of the twenty characters to be displayed. The first byte comprises four service bits of the display and four bits relating to the editing of the characters. One bit for each character points-out if two characters should be superimposed on a same position on printing line or on display 21 and three other bits relate to the status of selector 85. The second Byte relates to the code of the character to be displayed.

Microprocessor 207 and a gate 209 serially convert the bits of the second Byte of each character to signals to be memorized in shift registers 204 and 206, through a character generator ROM 208, to set 11 rows of the cells of display 24. If only a character is to be displayed on a given cell of 21, the superimposition bit is high and the signals read on ROM 208 are temporarily stored in microprocessor 207 and thereafter directly transmitted to shift register 204. If on the contrary, two characters have the same position, after the store of first characters in microprocessor 207, through line 210 gate 209 is prevented from transmitting this signal to register 204. The second character is converted, and microprocessor 207 provides a logic "OR" of the signals relative to the two characters which are thereafter staticized on shift register 203 through gate 209 preset by line 210.

The three bits of first Byte of character received by microprocessor 207 are on the contrary directly used to set the dots 213 of the 12th rows of each cell of display 21 as herein before described. According to the cited patent application 58,202 the printing line is stored in a buffer 160 of RAM memory 105 (FIG. 4) and comprises, inter alia, the following as pointer of Buffer memory 160:

PU BUF is a working pointer on Buffer 160.

IST from which defines the point the printing of characters begins.

FST defines the end point of the printing of character in buffer.

PIDS defines the first character to be loaded in display without printing.

FIDS defines the last character loaded in display 21.

Storage of character and the printing thereof occur as in the cited application 58,202.

Figure 7:
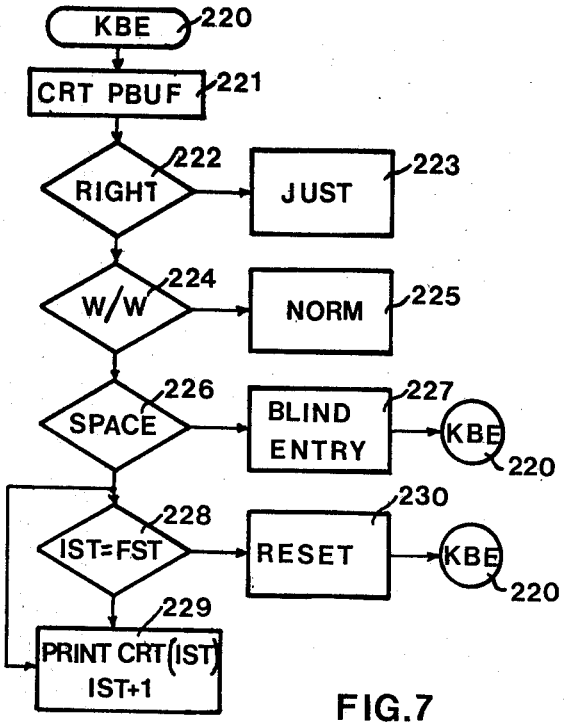
FIG. 7 is a flow chart of an operation mode of the typewriter of FIG. 1.

FIG. 7 shows an exemplary flow chart relating to word by word delayed writing of the stored characters wherein the KBE routine 220 relates to actuation of a key which moreover sends the last character stored in buffer 160 to cell CRT of microcomputer 207 and copies this character on PBUF. Through branch 222, the program determines the status of selector 86. If it is on RIGHT status, it follows as in the right margin justification routine of the cited application 58,202. If it is on NORM status, the program controls W/W store (FIG. 4) if selector 63 is on by WORD status; in the negative, it follows with point 225 (FIG. 7) to display the character and prosecute with normal storing and printing thereof as in the cited application 58,202. If the store W/W is to 1, the program follows with branch 226 wherein the operation of the SPACE bar or a character key 57 is controlled. If not the SPACE bar, but a character key has been depressed, the character code is stored in buffer 160 for a blind writing, it appears on display 21 and program returns to 220 block. If the SPACE bar has been depressed, the program controls in 228 if the first IST and last FST characters to be printed on buffer 160 have the same position. In the negative, the content of CRT (IST) is printed by the unit 25, pointer IST is increased by 1, on block 229 and the program continues to print the stored characters until IST=FST. At this time, the program resets specific stores and return to 220 block.

What we claim is:

1. An electronic typewriter comprising a keyboard for entering data;

a printing unit for printing entered data along printing positions of a printing line;

editing means operable to select an editing state of the typewriter to modify the printing positions of entered data, wherein said editing means include editing selector means and/or editing keys operable according to a selected editing mode, memory means for storing, without printing, said entered data, display means for displaying last entered data, and service keys operable to cause the printing unit to print the data stored in said memory means on modified printed positions of the printing line according to the selected editing mode of said editing selector means and/or editing keys;

word/word selector means operable to select a word-/word state of the typewriter for storing, without printing and without modifying the printing positions, a plurality of entered data defining a word;

means responsive to the operation of said service keys including a space bar jointly with selected word-/word state of the typewriter for causing the print unit to print said plurality of entered data word by word; and control means for rendering said word/word selector means ineffective on selection of said word/ word state when said editing selector means and/or editing keys are operated according to a selected editing mode.

2. An electronic typewriter according to claim 1, wherein said display means comprises a row of display positions having a first part wherein last entered data are displayed and a second part for displaying the editing state and the word/word state of the typewriter.

3. An electronic typewriter comprising a printing unit for printing entered data, presetting means for presetting a mode of a plurality of modes producing an emphasis of the entered data by one of underlining print, heavy print, reverse print of entered data and a combination of said ways of emphasis, a display device of the matrix type comprising dots which are made selectively luminous for displaying the entered data and a row of emphasizing dots below the dots of the matrix, and emphasizing means which respond to a preset mode to display in an emphasized manner in relation to the other data the entered data which is to be emphasized by selectively making luminous any of said emphasizing dots according to a predetermined code associated with said mode.

4. An electronic typewriter according to claim 3, wherein said data are defined by a digital code including a plurality of bits, and comprising a matrix memory responsive to the plurality of bits of said input means for generating signals associated to said bits, a display memory to store the signals of said matrix for displaying the entered data and wherein the code of said data includes further bits associated with the preset emphasizing mode and microprocessor means which are operable to store said further bits for displaying said emphasizing dots.

5. An electronic typewriter comprising a display device having a plurality of display positions;

input means for entering items of data defined by a digital code including a plurality of bits identifying said items;

a matrix memory responsive to said plurality of bits for generating matrix signals associated to said bits;

a display memory responsive to said matrix signals for storing said matrix signals and feeding the display device with stored signals for displaying entered items of data; and circuit means which represent in one and the same position of the display, in a superposed relationship, two items of said items of data, defining a superposed item of data, wherein the digital code of each item includes a superposed bit identifying if said item is to be represented superposed to another item;

wherein said circuit means comprise store means responsive to said superposed bit for temporarily storing the matrix signals of a first item of said two items of data, means for preventing the matrix signals of said first item from being stored in said memory, and microprocessor means for transmitting to said display memory the matrix signals of the second item of said two items in a logic combination with the matrix signals of said first item defining superposed item.

* * * * *